US009151081B2

(12) United States Patent
Thomson

(10) Patent No.: US 9,151,081 B2
(45) Date of Patent: Oct. 6, 2015

(54) LOCKABLE CONTAINERS

(71) Applicant: IdeaStream Consumer Products, LLC, Cleveland, OH (US)

(72) Inventor: Vincent J. Thomson, Avon Lake, OH (US)

(73) Assignee: Ideastream Consumer Products, LLC, Cleveland, OH (US)

( * ) Notice: Subject to any disclaimer, the term of this patent is extended or adjusted under 35 U.S.C. 154(b) by 0 days.

(21) Appl. No.: 14/534,685

(22) Filed: Nov. 6, 2014

(65) Prior Publication Data

US 2015/0128666 A1 May 14, 2015

Related U.S. Application Data

(63) Continuation-in-part of application No. 29/479,850, filed on Jan. 21, 2014, and a continuation-in-part of application No. 29/479,855, filed on Jan. 21, 2014, and a continuation-in-part of application No. 29/499,669, filed on Aug. 18, 2014, and a continuation-in-part of application No. 29/507,042, filed on Oct. 23, 2014.

(Continued)

(51) Int. Cl.
*E05B 67/38* (2006.01)
*E05B 65/52* (2006.01)

(Continued)

(52) U.S. Cl.
CPC ..... *E05B 65/5284* (2013.01); *A44B 19/301* (2013.01); *E05B 37/02* (2013.01); *Y10T 70/5053* (2015.04)

(58) Field of Classification Search
CPC .... A44B 19/301; A44B 19/30; A45C 13/103; E05B 37/12; E05B 65/52
USPC ..... 70/68, 63–67; 24/418, 419, 436; 150/101, 102, 133, 134; 190/101, 190/117–121, 903; 383/5, 97
See application file for complete search history.

(56) References Cited

U.S. PATENT DOCUMENTS 1,680,652 A * 8/1928 Walinsky ..... 70/68
2,183,121 A * 12/1939 Levine ..... 70/68

(Continued)

FOREIGN PATENT DOCUMENTS

CN 103315467 9/2013
WO 2012112633 8/2012

OTHER PUBLICATIONS

U.S. Searching Authority, International Search Report and Written Opinion in corresponding application No. PCT/US2014/064789 (May 18, 2015).

*Primary Examiner* — Lloyd Gall
(74) *Attorney, Agent, or Firm* — Fay Sharpe LLP

(57) ABSTRACT

A container that includes a lockable zipper. The container includes a cavity having an opening. A zipper is provided that includes first and second rows of teeth and a slider. The first row of teeth is connected on one side of the opening and the second row of teeth is connected on an opposite side of the opening. The slider is configured to cause the rows of teeth to mesh together when the slider is moved to the closed position and to cause the rows of teeth to separate when moved to the open position. A locking arrangement is provided that includes a lock mechanism and a locking latch opening. A locking latch is provided that is designed to be releasably connected to the locking latch opening. The locking latch is designed to prevent the slider from moving to a fully open position when the locking latch is locked in the locking latch opening. The locking latch is designed to allow the slider to move to a fully open position when the locking latch is released from the locking latch opening.

16 Claims, 9 Drawing Sheets

Related U.S. Application Data

(60) Provisional application No. 61/902,522, filed on Nov. 11, 2013, provisional application No. 61/924,831, filed on Jan. 8, 2014.

(51) Int. Cl.
*A44B 19/30* (2006.01)
*E05B 37/02* (2006.01)

(56) References Cited

U.S. PATENT DOCUMENTS

| | | | | | |
|---|---|---|---|---|---|
| 3,141,536 | A * | 7/1964 | Fulton | 190/119 |
| 3,965,706 | A * | 6/1976 | Davis | 70/68 |
| 3,971,458 | A * | 7/1976 | Koenig | 190/120 |
| 3,973,419 | A * | 8/1976 | Atkinson | 70/68 |
| 4,031,724 | A * | 6/1977 | Atkinson | 70/68 |
| 4,213,314 | A * | 7/1980 | Trader | 70/68 |
| 4,790,156 | A * | 12/1988 | Yang | 70/68 |
| 4,817,769 | A * | 4/1989 | Saliba | 190/18 R |
| 5,916,280 | A * | 6/1999 | Lantz | 70/68 |
| 6,533,335 | B2 * | 3/2003 | Hudson | 292/307 R |
| 7,313,879 | B2 * | 1/2008 | Ward | 40/771 |
| 8,499,804 | B2 * | 8/2013 | Schulte | 150/102 |
| 2004/0237605 | A1 * | 12/2004 | Lin et al. | 70/68 |
| 2006/0016531 | A1 * | 1/2006 | Volk et al. | 150/102 |
| 2009/0065382 | A1 * | 3/2009 | Perri et al. | 206/231 |
| 2011/0142375 | A1 | 6/2011 | Lebow | |

* cited by examiner

LOCKABLE CONTAINERS

The present invention claims priority on U.S. Provisional Patent Application Ser. Nos. 61/902,522 filed Nov. 11, 2013 and 61/924,831 filed Jan. 8, 2014, both of which are incorporated herein by reference.

The present invention is a continuation-in-part of U.S. patent application Ser. No. 29/479,850 filed Jan. 21, 2014; Ser. No. 29/479,855 filed Jan. 21, 2014; Ser. No. 29/499,669 filed Aug. 18, 2014; and Ser. No. 29/507,042 filed Oct. 23, 2014, all of which are incorporated herein by reference.

The present invention is directed to lockable containers, and more particularly to lockable containers that include a locking zipper.

BACKGROUND OF THE INVENTION

There are many zipper containers that are designed to include various types of items. However, many of these zipper containers cannot be securely closed to inhibit or prevent access to the container and the one or more items in the container. For example, keys, make-up, medications, money, self-protection items (e.g., mace, firearm, etc.), sharp items (e.g., scissors, letter opener, knife, etc.), electronic devices (e.g., phone, USB drive, memory cards, headphones, etc.), eye glasses, and other or additional items can be included in a purse. Some of these items may be included in a zipper container, whereas other items are merely contained in the purse. It is common for children, young adults and other adults to view or access items in the purse without the owner's knowledge. As such, free access to items in a purse could injure or be otherwise harmful to an unauthorized accesser, be personal items that the owner does not want others to see, and/or the items can be damaged by the unauthorized accesser.

There are also many items that are included in the home to which a user may not want others to have free access (e.g., medications, firearms, electronic devices, make-up, personal items, etc.). However, many of these items are contained in unsecured or easily accessible containers.

SUMMARY OF THE INVENTION

The present invention is directed to a zippered container that can limit or prevent access to items in the container. The material, size, shape, color or configuration of the zipper container is non-limiting. The material, size, shape, color or configuration used to form the zipper and/or lock arrangement is non-limiting. Generally, the material used for the zipper container includes a flexible material (e.g., fabric, plastic, flexible composite material, etc.); however, this is not required. The zipper container can include one or more compartments for the storage of materials (e.g., pens, pencils, erasers, note cards, jump drive, smart phone, calculator, ruler, correction liquid, tape, post-it-notes, paperclips, scissors, highlight pens, binder clips, pencil sharpener, tape, power cords, power chargers, e-readers, headphones, smart phone, tablets, GPS navigation devices, hygiene items, medications, medicinal products, firearms, firearm ammunition, make-up, memory cards, USB drives and other memory devices, phone, money, camera, electronic devices, vehicle keys, eyeglasses, sunglasses, credit cards, passport and other identification, documents, jewelry, video or software game discs or other game or software cartridge, vitamins, power or energy drinks, electric health devices, electronic music devices, electronic video devices, food items, candy, gum, snack foods, wipes, baby food or other infant items, clothing, personal hygiene items, hiking and camping equipment, sports equipment, hunting equipment, travel items, personal items, etc.). As can be appreciated, the container can be designed to hold any type of item. The number and size of the one or more pouches are non-limiting. The size, shape, material and configuration of the container are also non-limiting. In one non-limiting embodiment, the container is in the form of a pencil pouch, a gym bag, a purse, a backpack, a beverage container, a firearm case, a binder, a laptop or tablet container, a brief case, or a personal organizer case. The container can include one or more zippers. If two or more zippers are included on the container, one, a few or all of the zippers can include a locking arrangement. The zipper generally includes two rows of protruding teeth which are designed to interdigitate, thereby lining together the two rows. The teeth are generally formed of a metal or plastic material; however, other materials can be used. A slider, which is operated by the hand of the user, is designed to move along the rows of teeth. The slider generally includes a Y-shaped channel that meshes together or separates the opposing rows of teeth, depending on the direction of the movement of the slider. A lock latch is connected to the slider. The lock latch includes a lock structure that is designed to be secured to the locking arrangement when the zipper is in the closed or nearly closed position. The lock latch is designed to be movable relative to the slider so that the lock latch can engage with and disengage from the locking arrangement. The shape, configuration and material of the lock latch are non-limiting. The locking arrangement is generally a combination lock or key lock. The combination lock, when used, is a lock in which a sequence of numbers or symbols is used to open the lock. The sequence may be entered using a single rotating dial which interacts with several discs or cams, or by using a set of several rotating discs with inscribed numerals or symbols which directly interact with the locking mechanism of the combination lock. The locking arrangement is generally formed of a durable material (e.g., metal, ceramic, composite materials, etc.). The size, shape, configuration and material of the locking arrangement are non-limiting.

One non-limiting object of the present invention is the provision of a lockable container that includes a zipper and a locking arrangement.

Another non-limiting object of the present invention is the provision of a lockable container that can easily and conveniently provide security and/or privacy to one or more items in a container.

These and other objects, features and advantages of the present invention will become apparent from the subsequent description taken in conjunction with the accompanying drawings.

BRIEF DESCRIPTION OF THE FIGURES

Reference may now be made to the drawings, which illustrate various non-limiting embodiments that the invention may take in physical form and in certain parts and arrangements of parts wherein.

DETAILED DISCUSSION OF NON-LIMITING EMBODIMENTS

Figure 1:
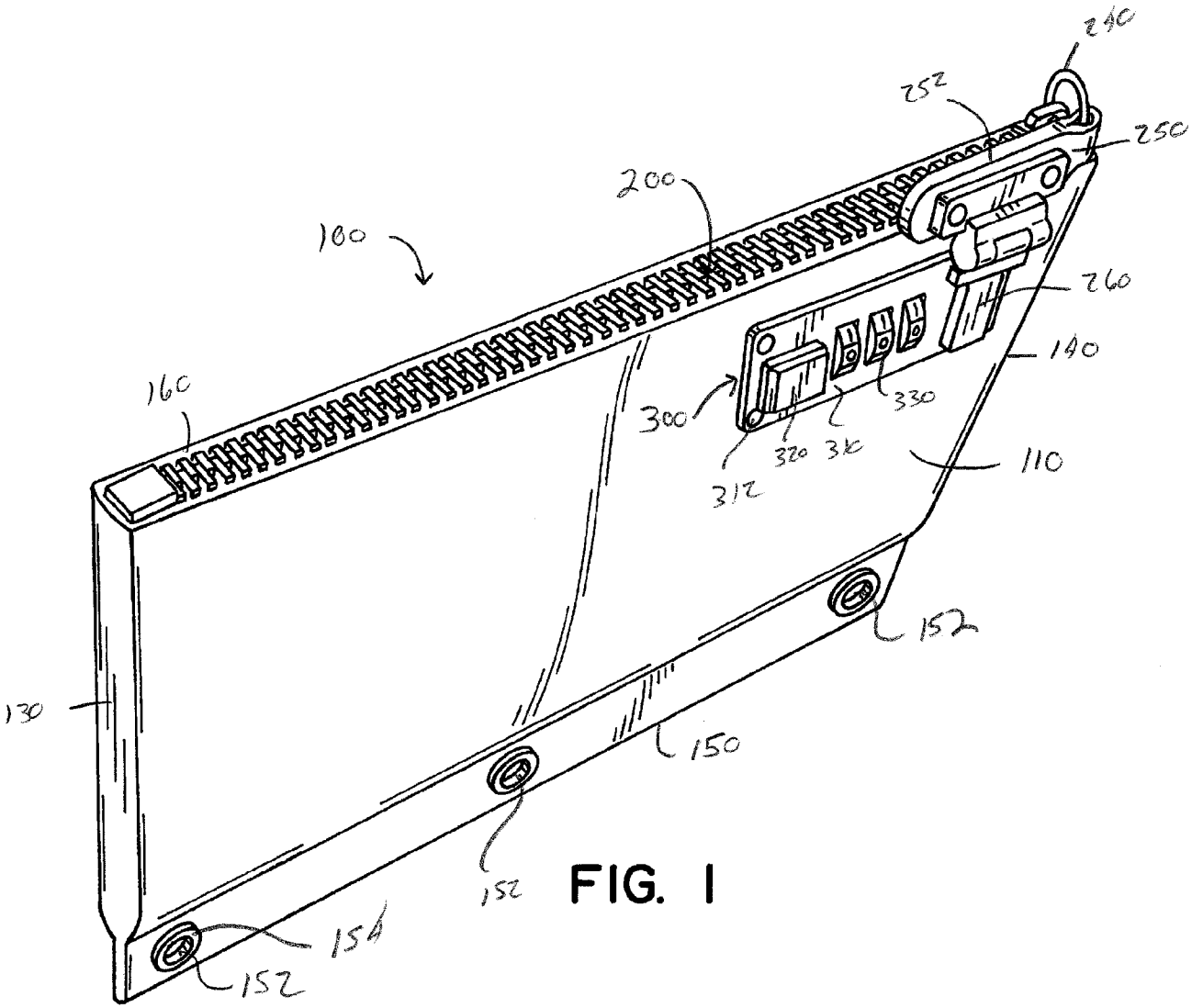
FIG. 1 is a front elevation view of a non-limiting pencil pouch that includes the lockable zipper arrangement in the fully zipped and locked position in accordance with the present invention.

Referring now to the drawings wherein the showing is for the purpose of illustrating non-limiting embodiments of the invention only and not for the purpose of limiting the same, FIGS. 1-13 illustrate non-limiting containers that include a locking arrangement in accordance with the present invention. Although the invention will be described with particular reference to a pencil pouch and a sports bag, it will be appreciated that the container can be any type of container (e.g., a gym bag, a purse, a backpack, a beverage container, a firearm case, a binder, a laptop or tablet container, a brief case, a personal organizer case, an electronic case, a digital media case, etc.). The types of items that can be placed in the container are non-limiting. The interior of the container can optionally include one or more pockets and/or compartments.

Referring now to FIGS. 1-8, there is illustrated a pencil pouch 100 for containing one or more pencils, pens or other types of writing implements (not shown). Although the container is identified as a pencil pouch for holding writing implements and related items, it can be appreciated that the pencil pouch can be used to hold many other or alternative items. The pencil pouch includes a generally rectangular front face 110 that includes a locking arrangement 300, a generally rectangular back face 120, two sides 130, 140, a bottom 150, and a top 160 that includes a zipper 200. As can be appreciated, the front face and the back face can have shapes other than a generally rectangular shape (e.g., circular, oval, polygonal, etc.). As can also be appreciated, the locking arrangement can be located on other areas of the pencil pouch (e.g., the back face, a side, the bottom, the top, etc.). As can also be appreciated, the zipper can be located on other areas of the pencil pouch (e.g., the front face, the back face, a side, the bottom, etc.). The pencil pouch can optionally include more than one zipper and/or more than one locking arrangement. The pencil pouch can be made of a flexible material (e.g., fabric, flexible plastic, flexible woven material, etc.); however, this is not required. The pencil pouch is generally a smaller container that can be easily handheld. Generally the surface area of each of the front face and back face is about 9-200 in.$^2$, and typically 16-100 in.$^2$; however, it can be appreciated that the front face and back face can have other surface areas. The volume of the pencil pouch is generally about 5-400 in.$^3$, and typically 16-200 in.$^3$; however, it can be appreciated that the pencil pouch can have other volumes. The weight of the pencil pouch, when empty, is generally less than 5 lbs., and typically less than 1.5 lbs. One or more sides of the pencil pouch can optionally include designs, inserts, decorative attachments, etc.

The bottom 150 of the pencil pouch can optionally include one or more openings 152 to enable the pencil pouch to be connected to a ring binder. The size, shape and positioning of the one or more openings are selected so that the rings in the ring binder can be inserted through the one or more openings. The one or more openings can optionally include a reinforcement ring 154 to inhibit to prevent damage to the opening. The bottom of the pencil pouch generally does not include an opening that allows items to be inserted or removed from the internal cavity 164 of the pencil pouch; however, this is not required.

Figure 7:
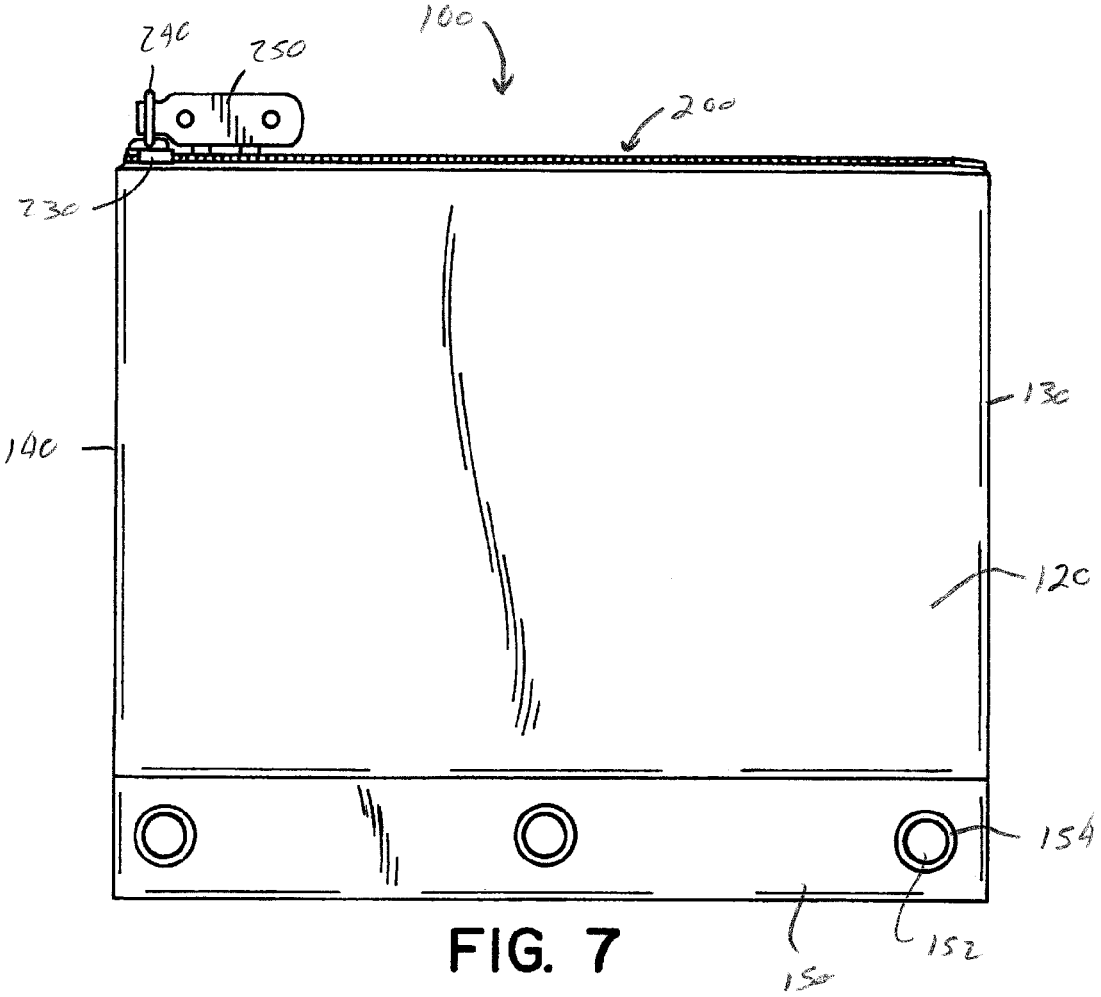
FIG. 7 is a back plan view of the pencil pouch of FIG. 1.
Figure 8:
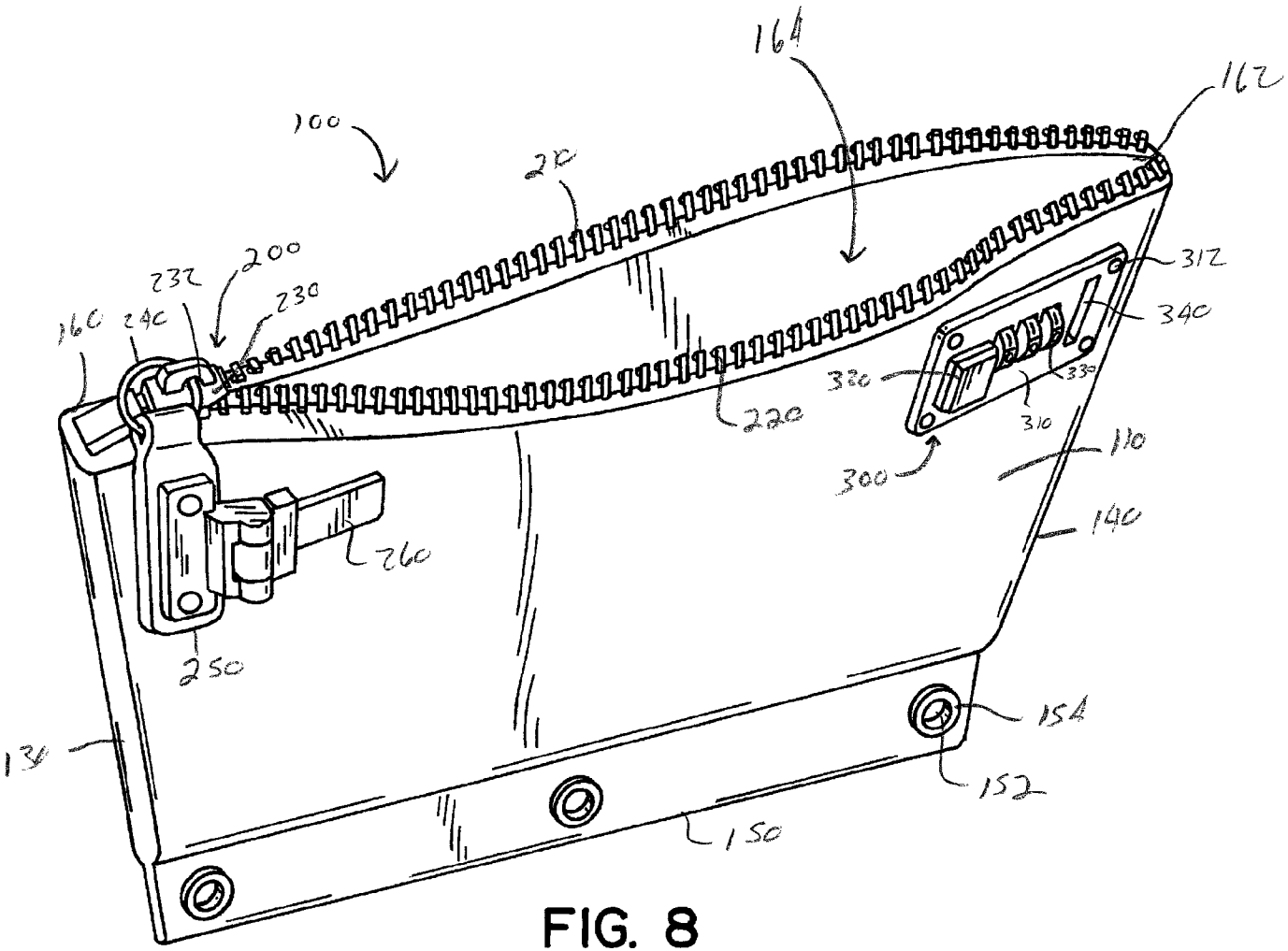
FIG. 8 is a front elevation view of the pencil pouch of FIG. 1 wherein the lockable zipper arrangement is in the fully unzipped and unlocked position.

The top 160 of the pencil pouch includes an opening 162 into the internal cavity 164 of the pencil pouch. The internal cavity is designed to hold the one or more items that are to be held in the pencil pouch. As can be appreciated, the pencil pouch can optionally include more than one cavity. The zipper 200 is positioned on the top of the pencil pouch; however, this is not required. The zipper includes two rows of teeth 210, 220 that are mostly positioned on each side of the opening 162 as illustrated in FIG. 8. The number and configuration of the teeth in each row are non-limiting. The zipper includes a slider 230 that is designed to mesh together or separate the opposing rows of teeth depending on the direction of movement of the slider. The size and configuration of the slider are non-limiting. FIGS. 7 and 8 illustrate the slider in the opened position and FIGS. 1-6 illustrated the slider in the closed position. When the slider is in the fully opened positioned, a plurality of the teeth in opposing rows of teeth are separated from one another and access to the internal cavity 164 of the pencil pouch is possible to allow items to be inserted or removed from the internal cavity 164 of the pencil pouch. When the slider is in the fully closed positioned, a plurality of the teeth in opposing rows of teeth are connected together and access to the internal cavity 164 of the pencil pouch is prohibited thus items cannot be inserted or removed from the internal cavity 164 of the pencil pouch.

Figures 2, 3, 4, 5:
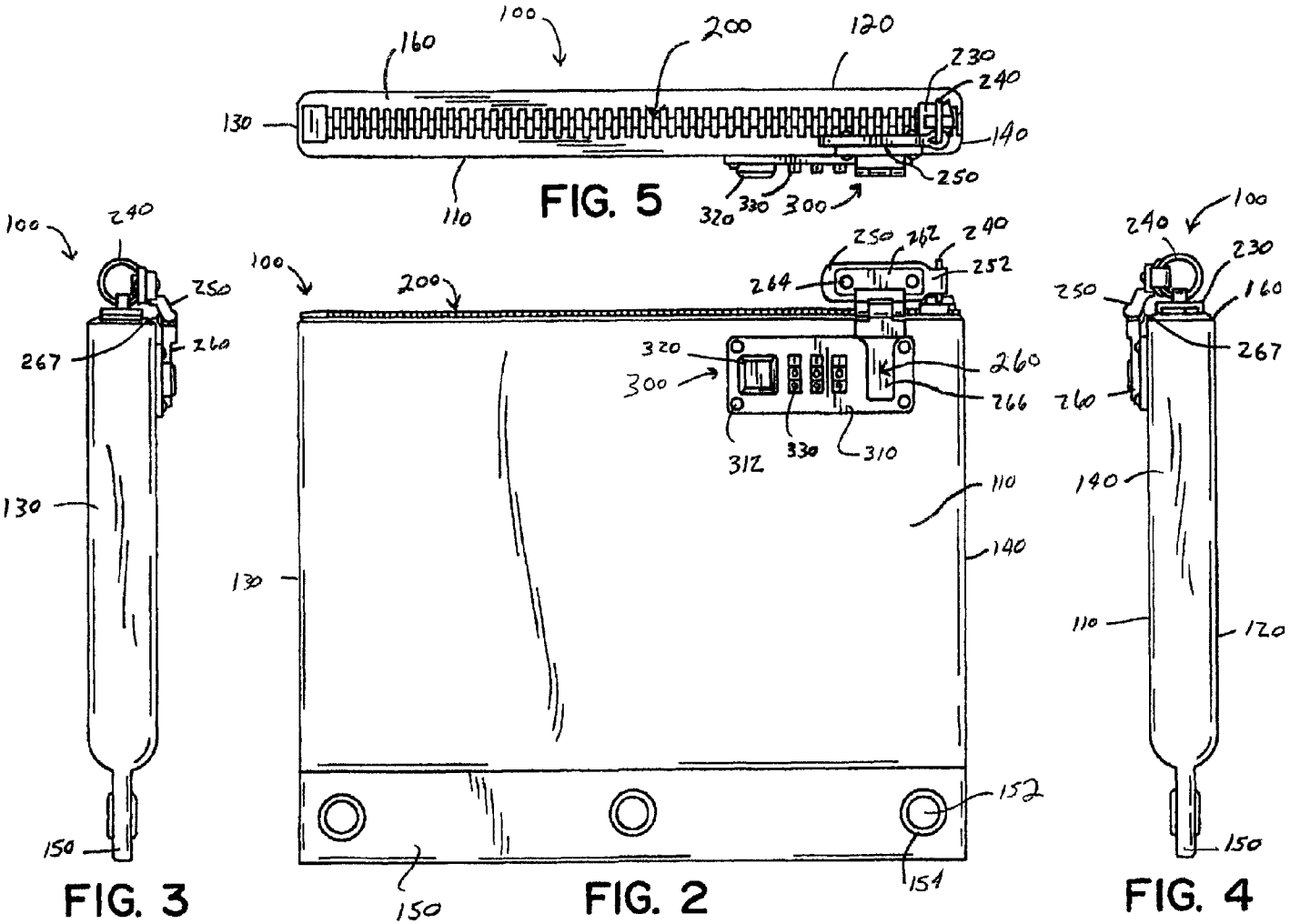
FIG. 2 is a front plan view of the pencil pouch of FIG. 1.
FIG. 3 is a side view of the pencil pouch of FIG. 1.
FIG. 4 is an opposite side view of the pencil pouch of FIG. 1.
FIG. 5 is a top plan view of the pencil pouch of FIG. 1.
Figure 6:
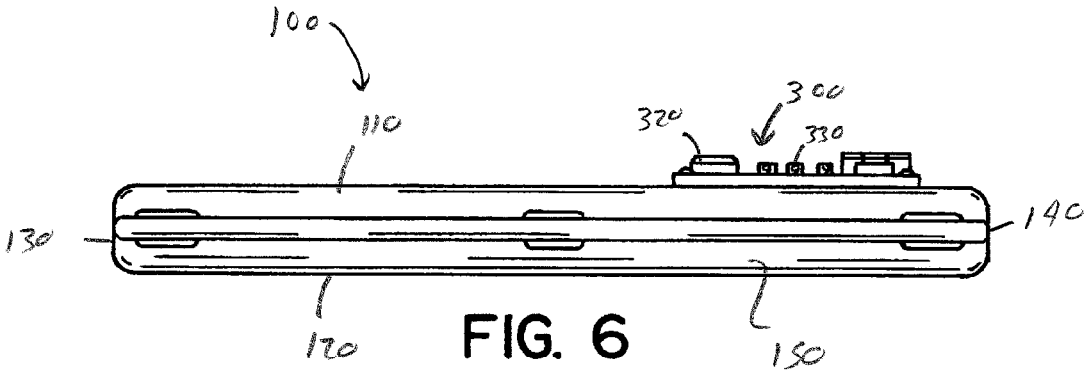
FIG. 6 is a bottom plan view of the pencil pouch of FIG. 1.
Figure 9:
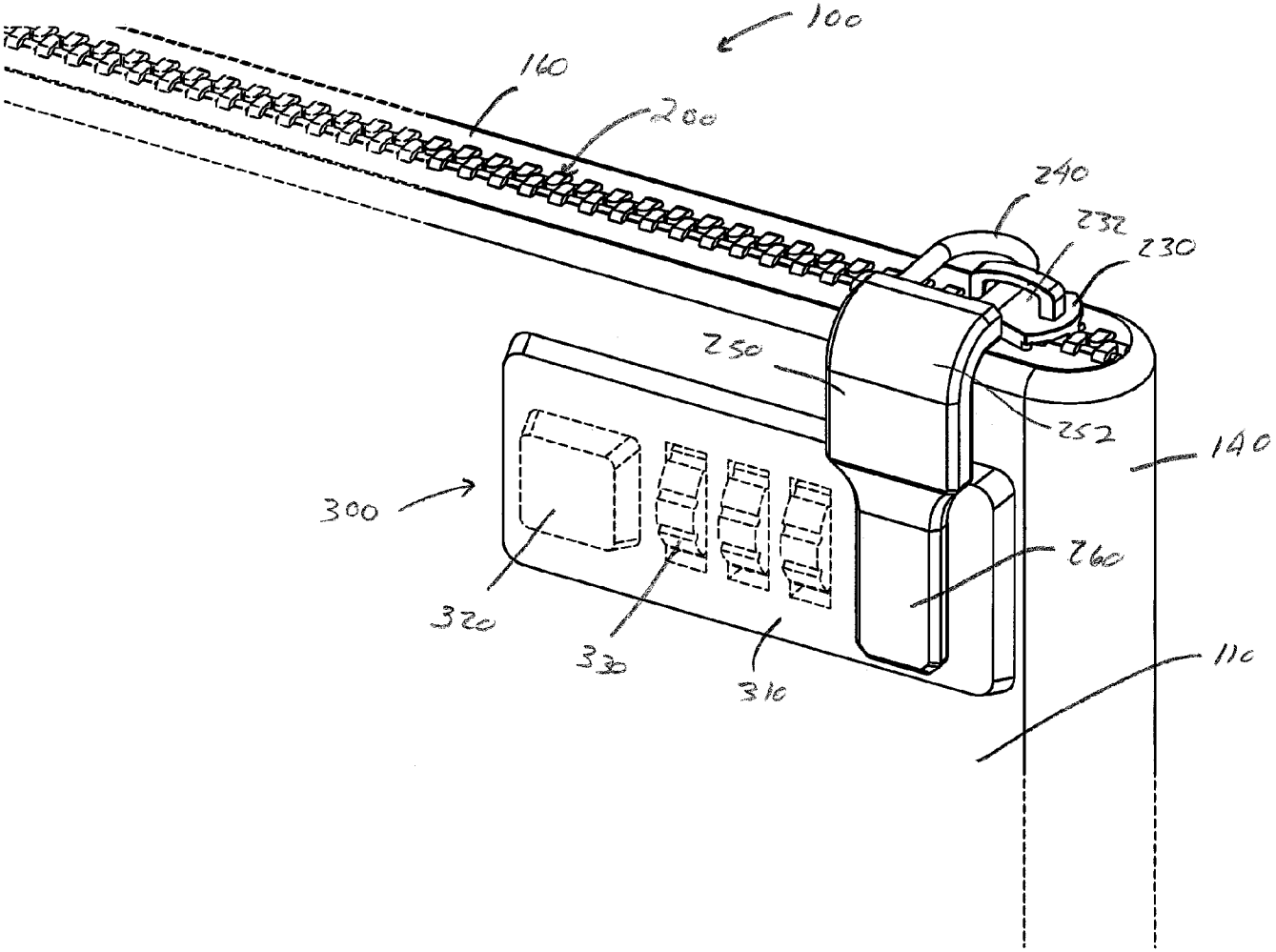
FIG. 9 is an enlarged view of an alternative lockable zipper arrangement in the zipped and locked position in accordance with the present invention.
Figure 10:
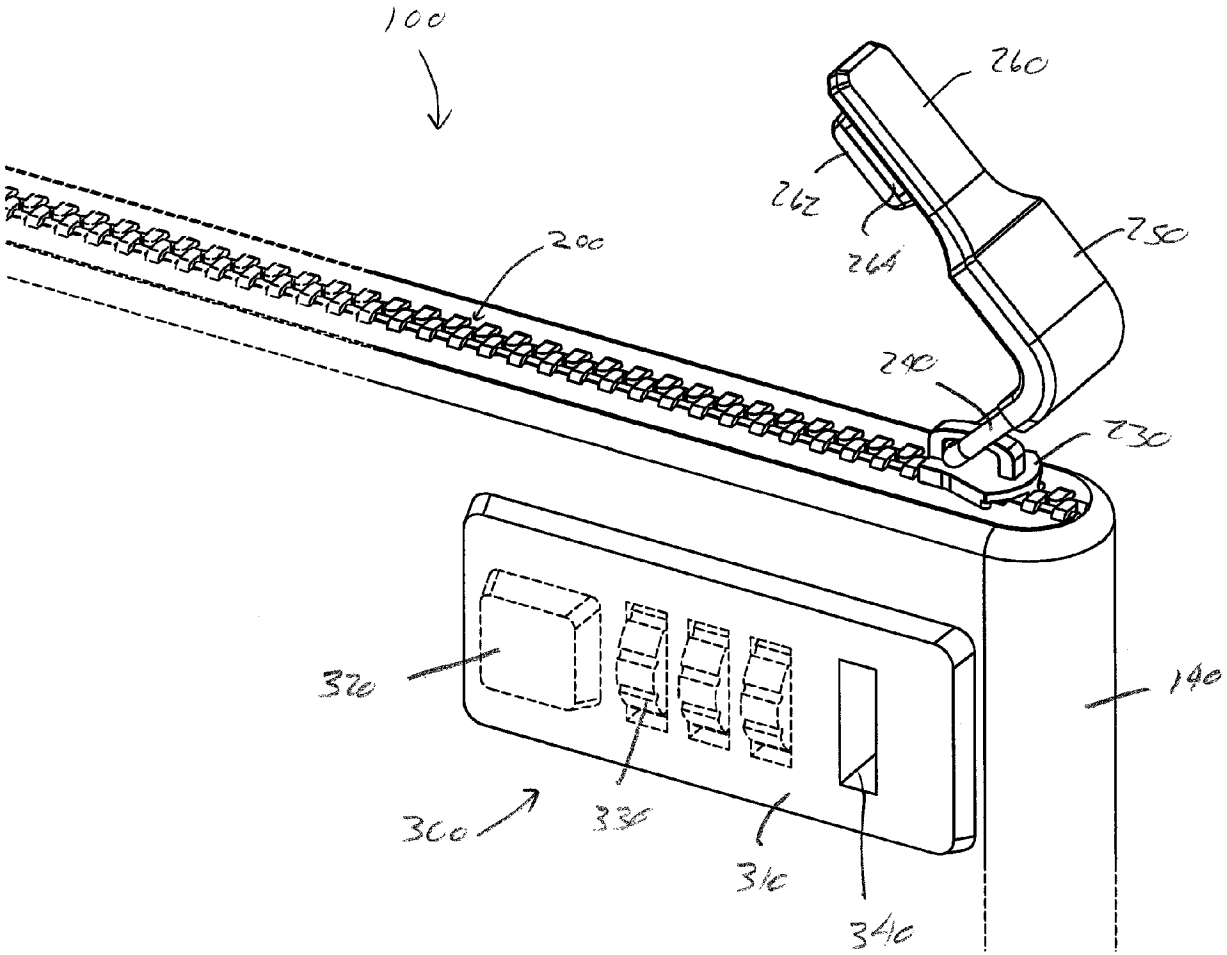
FIG. 10 is an enlarged view of the lockable zipper arrangement of FIG. 9 in the zipped and unlocked position.
Figure 11:
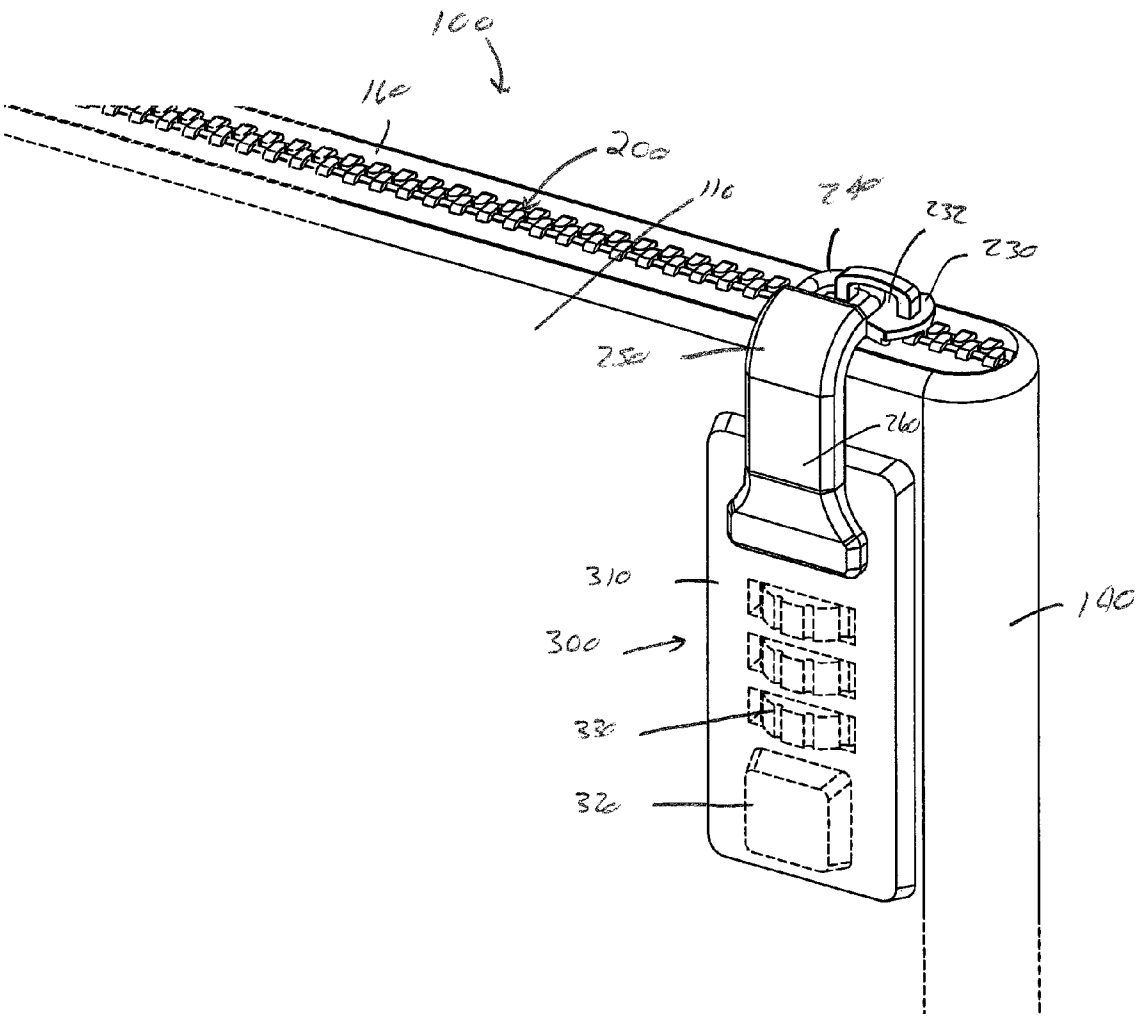
FIG. 11 is an enlarged view of an alternative lockable zipper arrangement in the zipped and locked position in accordance with the present invention.
Figure 12:
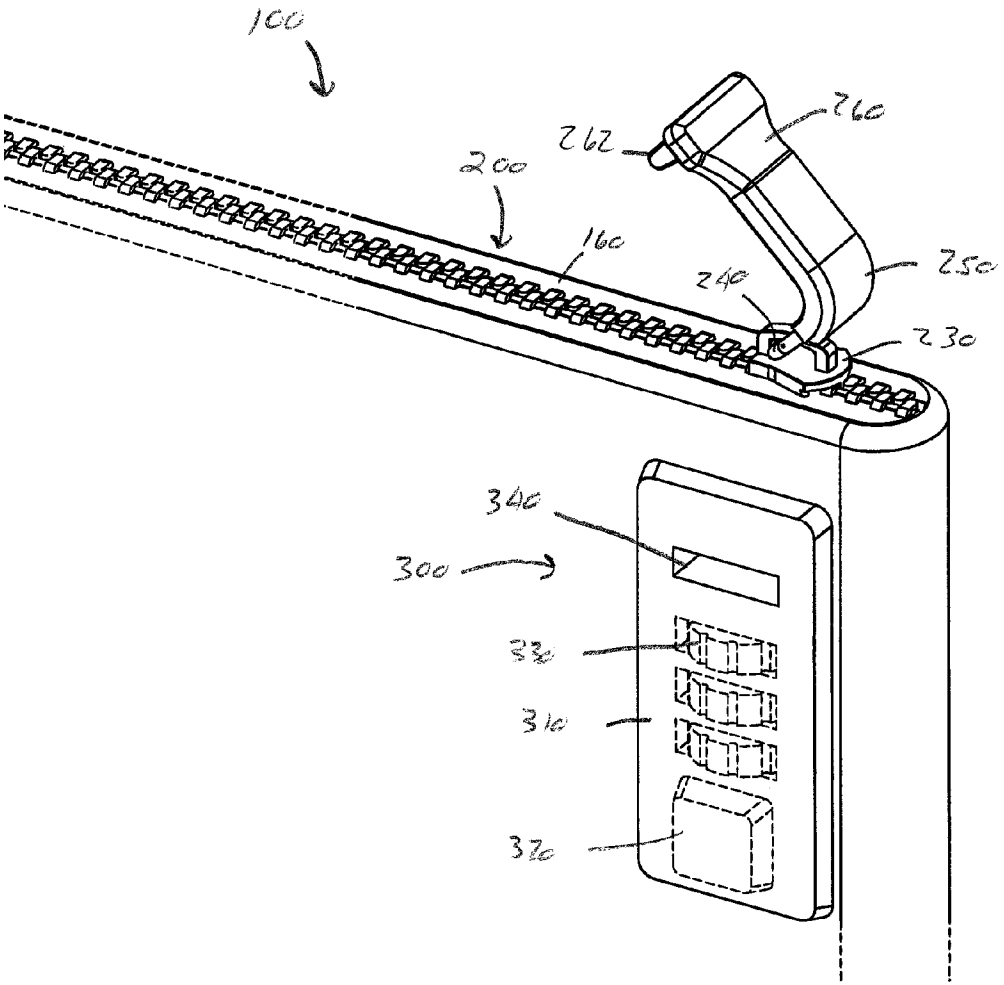
FIG. 12 is an enlarged view of the lockable zipper arrangement of FIG. 11 in the zipped and unlocked position; and, FIG. 13 is a front elevation view of a non-limiting sports bag that includes the lockable zipper arrangement in the fully zipped and locked position in accordance with the present invention.
Figure 13:
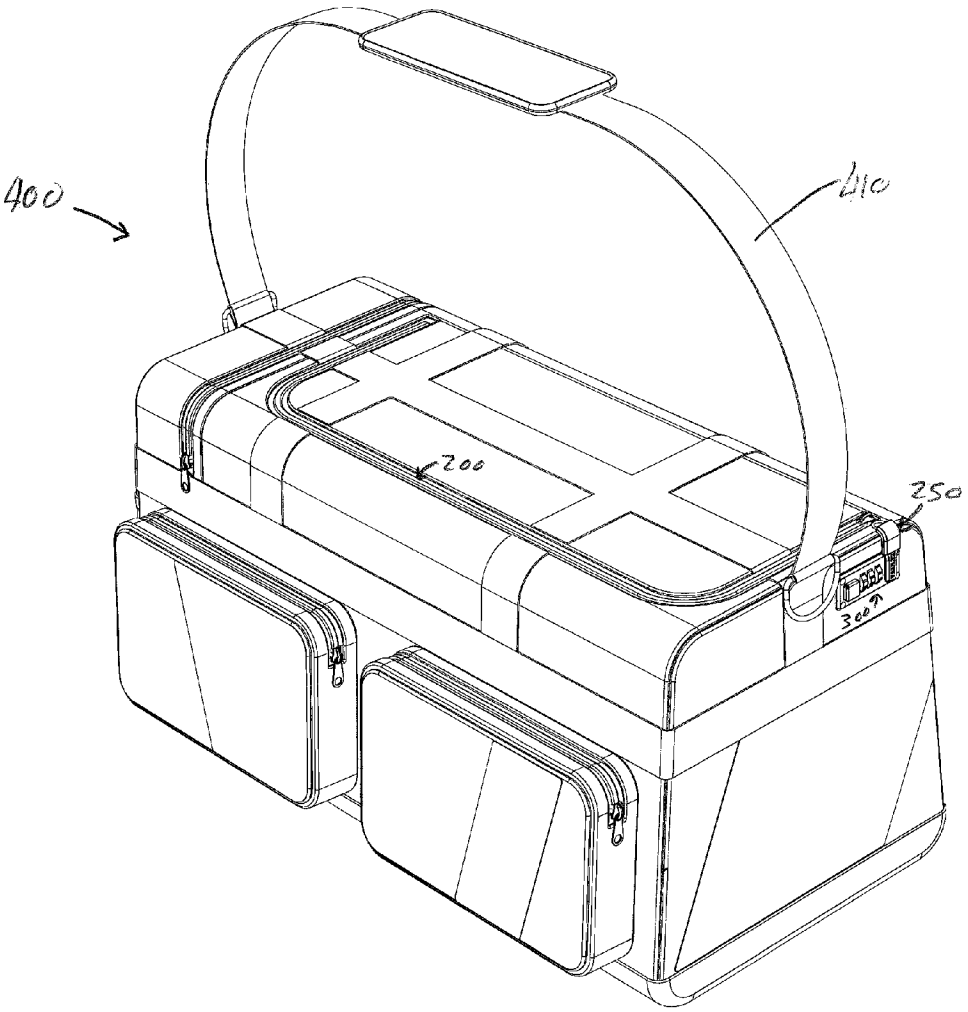

Slider 230 includes an opening 232 to enable a latch connector 240 to be connected to the slider. Generally, the latch connector 240 is moveable relative to the slider; however, this is not required. As illustrated in FIGS. 1, 3, 4 and 8, latch connector 240 is in the general form of a ring that is moveably positioned in opening 232 of the slider 230. As can be appreciated, the latch connector can have other shapes. A locking latch 250 is illustrated as connected to the latch connector 240. Generally, the latch connector or one or more portions of the latch connector are movable relative to the position of the slider to enable the locking latch to be moved into a locked and unlocked position relative to the locking arrangement. The configuration of the locking latch is non-limiting. FIGS. 1, 2 and 8 illustrate one non-limiting configuration of the locking latch. FIGS. 9, 10 and 13 illustrate another non-limiting configuration of the locking latch. FIGS. 11 and 12 illustrate still another non-limiting configuration of the locking latch. As can be appreciated, the locking latch can have many other configurations. For example, one or more portions of the locking latch can include and/or be formed into various shapes (e.g., super hero shapes, star shapes, skull shapes, zombie shapes, rainbow shapes, spider web shapes, insect shapes, animal shapes, letter shapes, sports shapes, sport figure shapes, etc.).

Referring again to FIGS. 1-8, the locking latch 250 includes an upper body portion 252 that includes an opening 254 to receive latch connector 240. The upper body portion of the locking latch is designed to move relative to the slider 240.

The upper body portion of the locking latch is generally designed to move relative to latch connector 240. The shape of the upper body portion is non-limiting. As illustrated in FIG. 2, the upper body portion has a generally rectangular shape; however, this is not required. A locking arm 260 is connected to the upper body portion of the locking latch. A portion of the locking arm is movable relative to the upper body portion; however, this is not required. As illustrated in FIG. 2, the locking arm includes an upper portion 262 that is connected to the top surface of the upper body portion. The upper portion can be connected to the upper body portion by a variety of means (e.g., adhesive, melted bond, rivet, clip, stitching, clamp, etc.). FIG. 2 illustrates that rivets 264 are used to connect the upper portion 262 to the upper body portion 252. The lower portion 266 of the locking arm is pivotally connected to the upper portion 262; however, this is not required. The lower portion 266 of the locking arm can optionally be spring biased in a certain position relative to the upper portion 262. Such a spring bias 267 is illustrated in FIG. 4. The lower portion of the locking arm includes a lock member (not shown) that is insertable into locking opening 340 in face plate 310, and thereby engages a locking mechanism in the locking arrangement. When the locking arm is secured to the locking arrangement, the slider of the zipper is prevented from moving to a position that would allow the zipper to be opened a sufficient amount to enable items to be removed from the internal cavity 164 of the pencil pouch. When the locking arm is released from the locking arrangement, the slider of the zipper can be moved so that the zipper can be opened a sufficient amount to enable items to be removed from the internal cavity 164 of the pencil pouch.

Referring now to FIGS. 9, 10 and 13, the locking latch 250 includes an upper body portion 252 that is rigidly connected to latch connector 240. In this arrangement, the latch connector is designed to move relative to slider 230, and upper body portion 252 is not designed to move relative to the latch connector. The shape of the upper body portion is non-limiting. As illustrated in FIGS. 9 and 10, the upper body portion has a generally J-shaped side profile; however, this is not required. A locking arm 260 is connected to the upper body portion of the locking latch. The locking arm is rigidly connected to the upper body portion and is not movable relative to the upper body portion. A majority of the lower portion of the locking arm has a width that is less than the upper body portion; however, this is not required. The lower portion of the locking arm includes a lock member 262 that is insertable into locking opening 340 in face plate 310 and thereby engages a locking mechanism in the locking arrangement. The shape of the lock member is non-limiting. As illustrated in FIG. 10, the lock member forms an opening 264 on the bottom surface of the lower portion of the locking arm that is used to engage a locking mechanism in the locking arrangement. When the locking arm is secured to the locking arrangement, the slider of the zipper is prevented from moving to a position that would allow the zipper to be opened a sufficient amount to enable items to be removed from the internal cavity 164 of the pencil pouch. When the locking arm is released from the locking arrangement, the slider of the zipper can be moved so that the zipper can be opened a sufficient amount to enable items to be removed from the internal cavity 164 of the pencil pouch.

Referring now to FIGS. 11 and 12, the locking latch 250 has a similar configuration as the locking latch illustrated in FIGS. 9, 10 and 13. The locking latch includes an upper body portion 252 that is rigidly connected to latch connector 240. In this arrangement, the latch connector is designed to move relative to slider 230, and upper body portion 252 is not designed to move relative to the latch connector. The shape of the upper body portion is non-limiting. As illustrated in FIGS. 11 and 12, the upper body portion has a generally J-shaped side profile; however, this is not required. A locking arm 260 is connected to the upper body portion of the locking latch. The locking arm is rigidly connected to the upper body portion and is not movable relative to the upper body portion. At least a portion of the lower portion of the locking arm has a width that is greater than the upper body portion; however, this is not required. The lower portion of the locking arm includes a lock member 262 that is insertable into locking opening 340 in face plate 310 and thereby engages a locking mechanism in the locking arrangement. The shape of the lock member is non-limiting. The lock member forms an opening (not shown) on the bottom surface of the lower portion of the locking arm that is used to engage a locking mechanism in the locking arrangement. When the locking arm is secured to the locking arrangement, the slider of the zipper is prevented from moving to a position that would allow the zipper to be opened a sufficient amount to enable items to be removed from the internal cavity 164 of the pencil pouch. When the locking arm is released from the locking arrangement, the slider of the zipper can be moved so that the zipper can be opened a sufficient amount to enable items to be removed from the internal cavity 164 of the pencil pouch.

The locking arrangement 300 is designed to maintain the slider 230 in the fully closed or nearly fully closed position. The locking arrangement is illustrated In FIGS. 1, 2, 5, 6, 8, 9, and 10 as positioned on the front face of the pencil pouch and in the upper corner of the front face; however, this is not required. Generally, the locking arrangement is positioned on a location of the pencil pouch that is at or in close proximity of the slider when the zipper is in the fully closed position; however, this is not required. The locking arrangement includes a face plate 310 that is secured to the pencil pouch by a variety of means (e.g., adhesive, melted bond, rivet, clip, stitching, clamp, etc.). As illustrated in FIGS. 1 and 2, a plurality of rivets 312 are used to secure the face plate to the front face of the pencil pouch. As illustrated in FIGS. 1, 2, 5, 6, 8, 9, 10 and 13, the face plate is positioned horizontally on the front face of the pencil pouch. FIGS. 11 and 12 illustrate the face plate positioned vertically on the front face of the pencil pouch. As can be appreciated, the face plate can have other orientations. The locking arrangement also includes a lock button 320 that is movable relative to the face plate. A plurality of rotating discs 330 with inscribed numerals and/or symbols (e.g., fruit shapes, star shapes, moon shapes, planet shapes, letters, etc.) are also positioned on in slots in the face plate and are movable relative to the face plate. The number of rotating discs is non-limiting (e.g., 2 discs, 3 discs, 4 discs, 5 discs, 6 discs, etc.). The number of numerals or symbols on each disc is non-limiting. When the proper sequence of numerals and/or symbols are selected on the rotating discs, the locking arrangement is in the opening position and the lock button can be used to release the locking latch 250 that is positioned in the locking opening 340 in face plate 310. The locking mechanism used in the locking arrangement is known in the art, thus will not be described herein. The locking opening is illustrated as having a generally rectangular shape that is oriented vertically on the front face of the pencil pouch (as illustrated in FIGS. 8 and 10). FIG. 12 illustrates the locking opening as having a generally rectangular shape that is oriented horizontally on the front face of the pencil pouch. As can be appreciated, the locking opening can have other shapes and/or be oriented in other ways on the front face of the pencil pouch.

Referring now to FIG. 13, there is illustrated a sports bag 400 that includes the lockable zipper arrangement. The locking arrangement 300 and locking latch 250 on the sports bag is similar to the locking arrangement and locking latch illustrated in FIGS. 9 and 10; however, it can be appreciated that the locking arrangement and locking latch can be similar to the locking arrangement and locking latch illustrated in FIG. 1-8 or 11-12. The sports bag is illustrated as having other zippers that do not include a locking arrangement; however, it can be appreciated that one or more of these zippers could include a locking arrangement. The sports bag is illustrated as including a plurality of closeable compartments; however, this is not required. Each of these closeable compartments is illustrated as closeable by a zipper; however, this is not required. The sports bag is illustrated as having a carrying strap 410; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims

What is claimed:

1. A container that includes a lockable zipper comprising:

a container that includes a front face, a back face, a top, a side and a cavity having an opening;

a zipper, said zipper positioned only on said top of said container, said zipper absent from said front face and said back face, said zipper including first and second rows of teeth and a slider, said first row of teeth connected to said top of said container and positioned on one side of said opening, said second row of teeth connected to said top of said container and positioned on an opposite side of said opening, said slider configured to move along the first and second rows of teeth and to cause said rows of teeth to mesh together when said slider is moved to a closed position and to cause said rows of teeth to separate when moved to an open position, said opening of said cavity being closed when said slider is in a fully closed position, said opening of said cavity open when said slider is in a fully open position; said front face extending in a direction which is substantially parallel to the zipper;

a locking arrangement, said locking arrangement including a lock mechanism and a locking latch opening, said locking arrangement positioned only on said front face of said container, said lock mechanism including a combination lock; and, a locking latch designed to be releasably connected to said locking latch opening, said locking latch is movably connected to said slider, said locking latch including a latch connector, an upper body portion, a locking arm, and a lock member, said latch connector connected to said upper body portion of said locking latch, said latch connector movably connected to said slider of said zipper, said locking arm connected to said upper body portion, said lock member connected to a bottom surface of said locking arm, said locking latch locked in said locking latch opening when at least a portion of said locking latch is positioned in said locking latch opening and said lock mechanism is in a locked state, said locking latch releasable from said locking latch opening when said lock mechanism is in an open state, said locking latch preventing said slider to move to said fully open position when at least a portion of said locking latch is in said locking latch opening and said lock mechanism is in a locked state, said locking latch allowing said slider to move to said fully open position when said locking latch is released from said locking latch opening.

2. The container as defined in claim 1, wherein said locking latch is rigidly connected to said latch connecter.

3. The container as defined in claim 1, wherein said locking arrangement includes a lock button that is movable relative to a face plate of said locking arrangement, a plurality of rotating discs with inscribed numerals, symbols or combinations thereof are positioned in slots in said face plate, said rotating discs movable relative to the face plate.

4. The container as defined in claim 2, wherein said locking arrangement includes a lock button that is movable relative to a face plate of said locking arrangement, a plurality of rotating discs with inscribed numerals, symbols or combinations thereof are positioned in slots in said face plate, said rotating discs movable relative to the face plate.

5. The container as defined in claim 1, wherein said container includes a plurality of ring openings in a base of said container.

6. The container as defined in claim 4, wherein said container includes a plurality of ring openings in a base of said container.

7. The container as defined in claim 1, wherein said container is in the form of a device selected from the group consisting of a pencil pouch, sports bag, a gym bag, a purse, a backpack, a beverage container, a firearm case, a binder, a laptop or tablet container, a brief case, a personal organizer case, an electronic case, and a digital media case.

8. The container as defined in claim 4, wherein said container is in the form of a device selected from the group consisting of a pencil pouch, sports bag, a gym bag, a purse, a backpack, a beverage container, a firearm case, a binder, a laptop or tablet container, a brief case, a personal organizer case, an electronic case, and a digital media case.

9. The container as defined in claim 6, wherein said container is in the form of a device selected from the group consisting of a pencil pouch, sports bag, a gym bag, a purse, a backpack, a beverage container, a firearm case, a binder, a laptop or tablet container, a brief case, a personal organizer case, an electronic case, and a digital media case.

10. The container as defined in claim 1, wherein a lower portion of said locking arm is spring biased connected to an upper portion of said locking arm.

11. The container as defined in claim 9, wherein a lower portion of said locking arm is spring biased connected to an upper portion of said locking arm.

12. A container that includes a lockable zipper comprising:

a container that includes a front face, a back face, a top, a side and a cavity having an opening, said container includes a plurality of ring openings in a base of said container;

a zipper, said zipper positioned only on said top of said container, said zipper absent from said front face and said back face, said zipper including first and second rows of teeth and a slider, said first row of teeth connected to said top of said container and positioned on one side of said opening, said second row of teeth connected to said top of said container and positioned on an opposite side of said opening, said slider configured to move along the first and second rows of teeth and to cause said rows of teeth to mesh together when said slider is moved to a closed position and to cause said rows of teeth to separate when moved to an open position, said opening of said cavity being closed when said slider is in a fully closed position, said opening of said cavity open when said slider is in a fully open position;

a locking arrangement, said locking arrangement including a lock mechanism and a locking latch opening, said locking arrangement positioned on said container in a location other than said top of said container, said lock mechanism including a combination lock; and, a locking latch designed to be releasably connected to said locking latch opening, said locking latch is movably connected to said slider, said locking latch including a latch connector, an upper body portion, a locking arm, and a lock member, said latch connector connected to said upper body portion of said locking latch, said latch connector movably connected to said slider of said zipper, said locking arm connected to said upper body portion, said locking arm including an upper portion and a lower portion, said lower portion pivotally connected to said upper portion, said upper portion connected to said upper body portion, said lock member connected to a bottom surface of lower portion of said locking arm, said locking latch locked in said locking latch opening when at least a portion of said locking latch is positioned in said locking latch opening and said lock mechanism is in a locked state, said locking latch releasable from said locking latch opening when said lock mechanism is in an open state, said locking latch preventing said slider to move to said fully open position when at least a portion of said locking latch is in said locking latch opening and said lock mechanism is in a locked state, said locking latch allowing said slider to move to said fully open position when said locking latch is released from said locking latch opening.

13. The container as defined in claim 12, wherein said locking arrangement is positioned only on said front face of said container.

14. The container as defined in claim 13, wherein said lower portion of said locking arm is spring biased connected to said upper portion of said locking arm.

15. A container that includes a lockable zipper comprising:

a container that includes a front face, a back face, a top, a side and a cavity having an opening;

a zipper, said zipper positioned only on said top of said container, said zipper absent from said front face and said back face, said zipper including first and second rows of teeth and a slider, said first row of teeth connected to said top of said container and positioned on one side of said opening, said second row of teeth connected to said top of said container and positioned on an opposite side of said opening, said slider configured to move along the first and second rows of teeth and to cause said rows of teeth to mesh together when said slider is moved to a closed position and to cause said rows of teeth to separate when moved to an open position, said opening of said cavity being closed when said slider is in a fully closed position, said opening of said cavity open when said slider is in a fully open position;

a locking arrangement, said locking arrangement including a lock mechanism and a locking latch opening, said locking arrangement positioned on said container in a location other than said top of said container, said lock mechanism including a combination lock; and, a locking latch designed to be releasably connected to said locking latch opening, said locking latch is movably connected to said slider, said locking latch including a latch connector, an upper body portion, a locking arm, and a lock member, said latch connector rigidly connected to said upper body portion of said locking latch, said latch connector movably connected to said slider of said zipper, said locking arm rigidly connected to said upper body portion, said locking arm including an upper portion and a lower portion, said upper portion of said locking arm connected to said upper body portion, said lower portion of said locking arm rigidly connected to said upper portion of said locking arm, said upper body portion having an arcuate shape, said lock member connected to a bottom surface of said lower portion of said locking arm, said locking latch locked in said locking latch opening when at least a portion of said locking latch is positioned in said locking latch opening and said lock mechanism is in a locked state, said locking latch releasable from said locking latch opening when said lock mechanism is in an open state, said locking latch preventing said slider to move to said fully open position when at least a portion of said locking latch is in said locking latch opening and said lock mechanism is in a locked state, said locking latch allowing said slider to move to said fully open position when said locking latch is released from said locking latch opening.

16. The container as defined in claim 15, wherein said locking arrangement is positioned only on said front face of said container.

* * * * *